United States Patent [19]

Bittner

[11] Patent Number: 4,531,341

[45] Date of Patent: Jul. 30, 1985

[54] CAN STUFFER AND METHOD

[75] Inventor: Norman Bittner, Cherry Hill, N.J.

[73] Assignee: Enviro-Spray Systems Incorporated, Montgomeryville, Pa.

[21] Appl. No.: 398,887

[22] Filed: Jul. 16, 1982

[51] Int. Cl.[3] ..... B65B 63/04

[52] U.S. Cl. ..... 53/117; 53/529; 493/419; 493/464

[58] Field of Search ..... 53/429, 117, 529, 438, 53/470; 493/407, 464, 419

[56] References Cited

U.S. PATENT DOCUMENTS

| | | | |
|---|---|---|---|
| 2,001,709 | 5/1935 | Davidson | 53/429 |
| 2,008,313 | 7/1935 | Presby | 493/464 |
| 3,481,268 | 12/1969 | Price | 53/529 X |
| 3,563,168 | 2/1971 | Doninger | 53/529 X |
| 3,576,162 | 4/1971 | McBrady | 53/529 X |
| 3,608,476 | 9/1971 | Price | 53/529 X |
| 3,694,992 | 10/1972 | Hunt | 53/438 |
| 4,126,501 | 11/1978 | Croll | 493/464 X |

*Primary Examiner*—John Sipos
*Attorney, Agent, or Firm*—Kenyon & Kenyon

[57] ABSTRACT

A can stuffer and method of stuffing a can with a flexible sheet product by placing the product in a generally flat receiver chamber and pushing the product edgewise to crowd the product into one edge region of the chamber by forming longitudinal folds or creases in the product to effectively reinforce and strengthen the product in the direction of the folds, and endwise ejecting or ramming the strengthened folded or creased product from the chamber into a container or can.

5 Claims, 7 Drawing Figures

FIG. 3
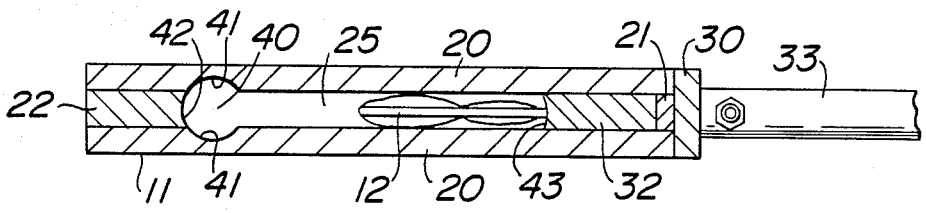
FIG. 4
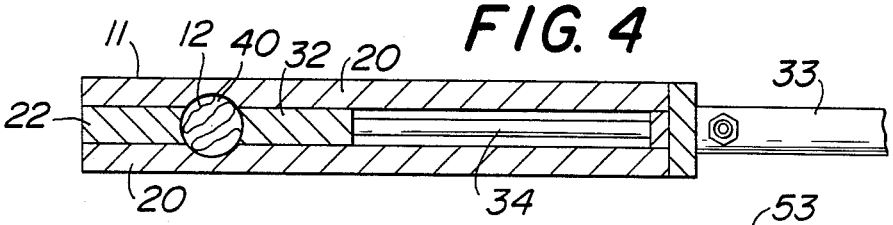
FIG. 5
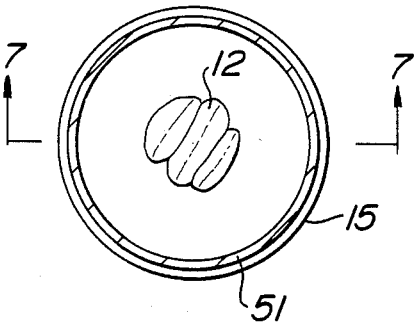
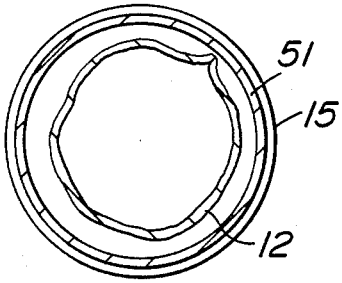
FIG. 6
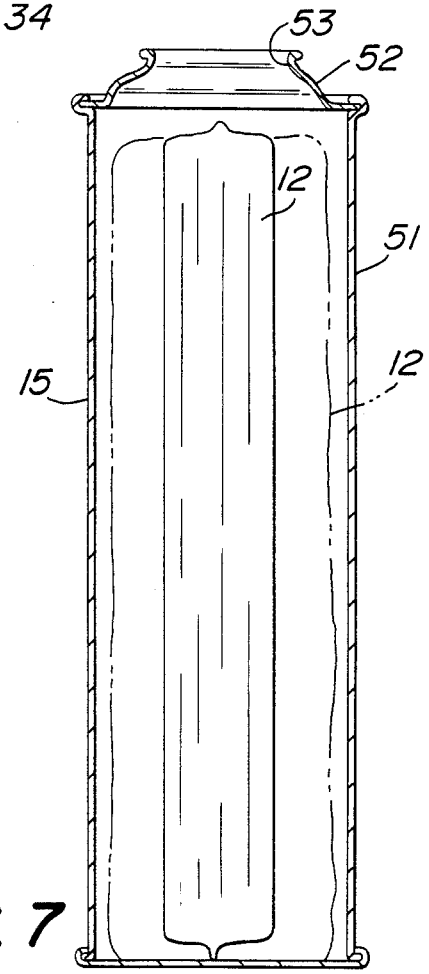
FIG. 7

CAN STUFFER AND METHOD

BACKGROUND OF THE INVENTION

The problem of stuffing products into containers has been approached in many processes, including the stuffing of cotton or other wadding into pill bottles, the insertion of a ball of wire into the envelope of a flash bulb, the placement of felt tips into marker bodies, and others. The applicant is aware of the below listed prior patents concerning the insertion of product in containers:

| U.S. PAT. NO. | PATENTEE |
|---|---|
| 1,777,252 | Braunstein |
| 2,895,273 | Lakso |
| 3,245,806 | Miller |
| 3,263,394 | Jensen |
| 3,336,646 | Chauvin |
| 3,694,992 | Hunt |
| 4,062,169 | Lister et al. |

While the method and apparatus of the present invention may be utilized in the stuffing or filling of containers with many different types of product, the instant invention has been primarily developed and employed for inserting expandable pouches into aerosol type dispensers, but wherein the propellant is created by chemical reaction within the pouch and expands the pouch to pressurize and propel the product, all without the propellant gas contacting the product or leaving the container.

SUMMARY OF THE INVENTION

It is an important object of the present invention to provide a method and apparatus for loading a flexible sheet product, such as a generally flat pouch, into a can or container wherein the container opening is of a dimension much less than one dimension of the pouch.

It is a further object of the present invention to provide a container loading method and apparatus wherein a generally flat flexible sheet product is crammed or crowded on edge to form plural longitudinal creases or folds with one dimension substantially reduced, and rammed in its creased condition into a container.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 3 is a horizontal sectional view taken generally along the line 3—3 of FIG. 2.

FIG. 4 is a horizontal sectional view generally similar to FIG. 3, but illustrating a slightly later stage of the instant method wherein the product has been creased or folded by crowding into a space of reduced dimension.

FIG. 5 is a horizontal sectional view taken generally along the line 5—5 of FIG. 2, showing the creased pouch being inserted into the container.

FIG. 6 is a sectional view similar to FIG. 5, but illustrating a resilient uncreasing or opening of the pouch as permitted by the enlarged interior of the container.

FIG. 7 is a longitudinal sectional view of the container, generally taken along the line 7—7 of FIG. 5, illustrating the creased pouch in solid lines, and the resiliently distended pouch condition in phantom.

DESCRIPTION OF THE PREFERRED EMBODIMENT

Figure 1:
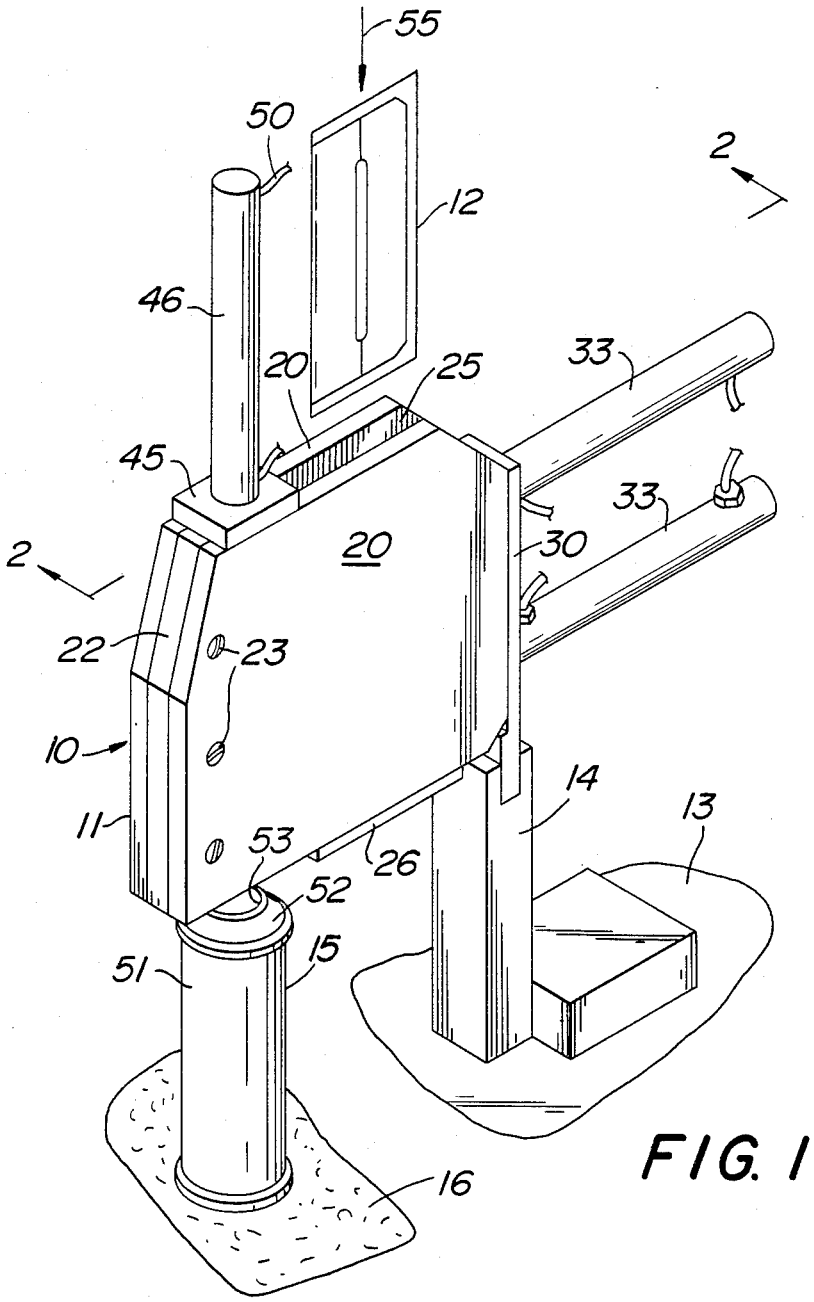
FIG. 1 is a top perspective view showing a loading apparatus constructed in accordance with the teachings of and practicing the method of the present invention.
Figure 2:
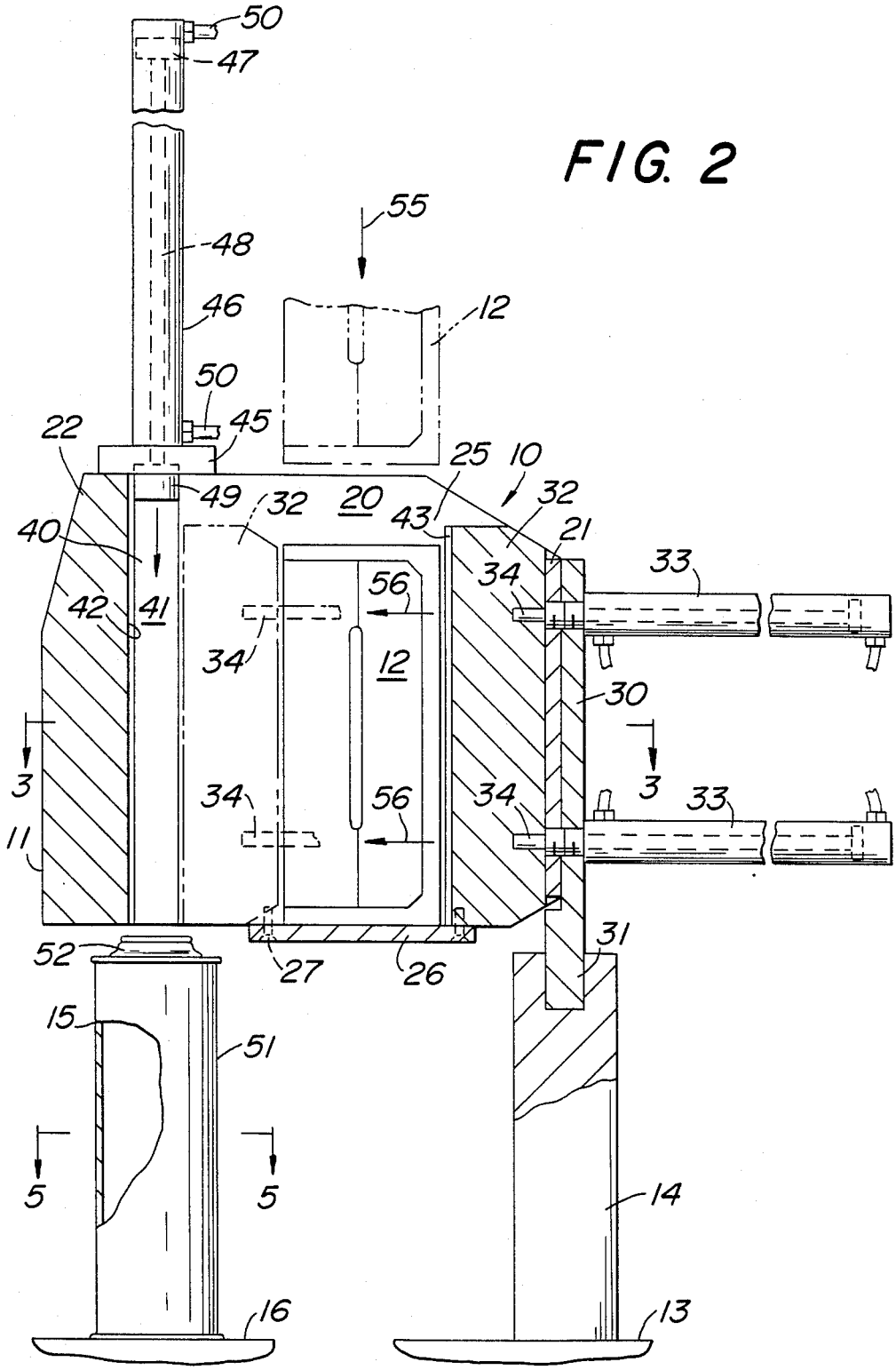
FIG. 2 is a longitudinal sectional elevational view taken generally along the line 2—2 of FIG. 1, illustrating in solid lines a pouch product having been deposited in the receiver of the apparatus, and illustrating in phantom the pouch position of FIG. 1 before deposit and also the position of the apparatus causing the pouch to be folded or creased.

Referring now to FIGS. 1 and 2 thereof, a loading device of the present invention is there generally designated 10, including a hollow receiver 11 for conformably receiving a generally flat pouch 12, and fixed to a base 13, as by a standard 14. A container or can 15 is shown in position beneath the receiver 11 for receiving the pouch 12, as will appear more fully hereinafter, and the container may be supported for movement into and out of the pouch receiving position, as by a conveyor 16.

More particularly, the receiver 11 may include a pair of parallel spaced, facing side walls 20, 20, a rear edge wall or strip 21 sandwiched between the rear edge margins of the side walls 20, and a front edge closure or block 22 sandwiched between the front edge margins of the side walls 20. Suitable securing means may be employed to hold the side walls 20, rear wall 21 and front wall 22 in their assembled relation, such as fasteners 23. The space between the upright side walls 20, rear wall 21 and front wall 22 defines a generally vertically disposed, flat receiver chamber 25. The underside or lower end of the chamber 25 is partially closed by a partial bottom wall 26 secured to the lower surfaces of the side walls 20, as by fasteners 27. The partial bottom wall 27 is spaced rearwardly from the front edge wall 22, and may be spaced forwardly from the rear edge wall 21. Thus, the receiver chamber 25 opens upwardly throughout its forward and rearward extent, while its underside or bottom is at least partially closed, being open in the forward region adjacent to forward edge wall 22.

An upright mounting member or plate 30 may extend laterally across the rear surfaces of the receiver sides 20 and rear edge member 21, being suitably secured thereto by any desired means, and depends rigidly therefrom to have its lower end region 31 fixed to the upright standard 14. The upright or standard 14 is suitably fixed to a base, bed or table 13.

Interiorly of the chamber 25, extending generally vertically therein along the rear edge member 21, is a block, crosshead or pusher 32. The pusher 32 is generally of vertical extent and slidable horizontally in the receiver 11, as between its rearward or retracted solid line position adjacent to the rear edge member 21 (see FIG. 2) and a forward or extended position, shown in phantom, adjacent to and spaced rearwardly from the forward edge member 22. These rearwardly retracted and forwardly extended positions are also shown in FIGS. 3 and 4, respectively.

Suitable actuating means are provided for effecting the forward and rearward shifting movement of the pusher 32, such as fluid operated piston-in-cylinder assemblies 33 mounted to the members 21 and 30 and having piston rods 34 carrying the pusher block 32.

The interior forward edge region of the chamber 25 is transversely enlarged, as at 40, best seen in FIGS. 3 and 4. With the pusher 32 shifted forwardly, as in FIG. 4, the transversely enlarged, forward edge region 40 of the chamber 25 defines a rounded or generally cylindrical internal configuration. Specifically, the side walls 20 are each internally configured with internal cylindrical segments 41, the front edge member 22 being internally configured with an internal cylindrical segment 42, and the forward edge surface 43 of the pusher 32 being configured with an internal cylindrical segment, all of which segments are continuous in the forward pusher position of FIG. 4. Thus, the transversely enlarged, vertically extending forward edge region of chamber 25 defines the interior of a cylinder, which chamber region opens upwardly and downwardly through the receiver 11.

Secured on the upper side of the receiver 11, fast to the upper edges of the side walls 20 over the forward chamber region 40, is a cylinder mounting member or plate 45, carrying an upstanding cylinder 46 including a reciprocable piston 47, see FIG. 2. A piston rod 48 extends from the piston 47 through the mounting member 45 and is provided on its lower end with an ejector head or plunger 49. The ejector head or plunger 49 is generally cylindrical and shiftable vertically in the forward chamber region 40.

As illustrated in FIG. 2, the ejector 49 is retracted to its uppermost position in the forward chamber edge region 40. A suitable source of fluid under pressure, and control means therefor are connected to the cylinder 46, as by conduits 50.

The can or container 15 may be a conventional aerosol container, including a cylindrical body 51 having its upper end 52 provided with a reduced opening 53. That is, the body 51 may be of greater internal dimension than the opening 53.

The generally flat, flexible sheet product or pouch 12, may be fabricated, say of plastic sheeting, metal foil, or the like, and provided with the necessary internal components, which may afford the pouch some bulk but permit of the necessary degree of crushing, folding or creasing, as will appear presently.

The flexible sheet product or pouch 12 may be gravitationally fed, as in the direction of arrow 55 into the chamber 25 to a position resting on the chamber bottom wall 26. This is shown in solid lines in FIG. 2. The pouch 12 is thus located between the pusher 32 and forward edge member 22.

The crosshead or pusher 32 is then shifted forwardly, as in the direction of arrows 56 to the phantom dotted-and-dash outline position. In this forward pusher position, see FIG. 4, the pouch 12 has been crowded and crammed into the forward chamber region 40, while being folded and creased to form a plurality of generally vertically extending folds or creases in the material of the pouch. Such longitudinal folds or creases effectively reinforce and strengthen the pouch to permit its endwise ejection as will appear presently.

That is, with the pouch 12 creased and crowded into the fold chamber region 40, below the upwardly retracted ejector or plunger 49 and directly above the opening 53 of the below supported container 15, the piston 47 is actuated downwardly. The plunger 49 engages the upper end of the creased pouch 12 and ejects the pouch endwise downwardly through the container opening 53 into the body 51 of the container. FIG. 5 may be considered as showing the pouch 12 before it has resiliently expanded to its open or distended position of FIG. 6. The resiliently open or relaxed, expanded position is shown in phantom in FIG. 7.

It will now be appreciated that the method practiced is that of deforming the generally flat product or pouch 12 by collapsing it edgewise into a transversely thickened product, but of greatly laterally reduced dimension by crowding the product into an edge region of the chamber 25 to form longitudinally extending folds or creases in the product. The thus thickened and longitudinally reinforced product is ejected endwise by the ram head or plunger 49 downwardly from the chamber region 40, retaining its reduced lateral dimension or width, for entry into the reduced mouth 53 of container 15. The ejector or plunger 49 may be sized to substantially occupy the cross section of chamber region 40.

In some circumstances it may be desirable to gradually enlarge the cross section of chamber region 40 in the downward direction, say to minimize resistance to ejection by the product. Also, a plunger 49 may be provided which closely fits the interior of chamber region 40 rather than the clearance fit illustrated; or, the plunger may be constructed to enlarge and decrease its size in accomodation to variation of the cross section of the chamber region 40.

From the foregoing, it is seen that the present invention provides a method and apparatus for loading a flexible sheet product such as a pouch, or the like, into a can or other container having an opening of a dimension much less than one dimension of the pouch, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. Apparatus for inserting an elongated expandable pouch into an aerosol-type container having therein a liquid product to be dispensed on demand and including a top opening substantially smaller than the width of the container and of the type wherein the expandable pouch includes separately compartmented internal gas generating components which expands said pouch to pressurize the container after it has been inserted therein, comprising:

a receiving chamber disposed between two substantially parallel plates and first and second opposing ends for receiving said elongated expandable pouch with its width parallel to said plates in a substantially vertical and unexpanded condition, said elongated pouch in the substantially unexpanded condition having a width substantially greater than the width of said opening of said container into which said elongated pouch is to be inserted;

pusher means mounted in said chamber between said plates and extending along said first end thereof, said pusher means being movable parallel to said plates between a first position adjacent said first end and a second position adjacent a second end, for deforming the expandable pouch in the chamber into an elongate temporarily collapsed product extending along the second chamber end, such that the temporarily collapsed pouch has a width at least as small as the width of the opening of the container, said receiving chamber having along said second end a cross section greater than the distance between said parallel plates for accommodating the elongate collapsed pouch to prevent crushing thereof and having a cross-sectional dimension not substantially larger than the opening in said container; and ejector means, movable in said chamber along said second end in a direction perpendicular to the direction of movement of said pusher for ejection of the temporarily collapsed pouch into a container disposed below said chamber at said second edge thereby allowing said pouch to expand within said container to pressurize and propel the product to be dispensed.

2. Apparatus as recited in claim 1 wherein said ejector means has a cross section substantially completely occupying said enlarged cross section of said chamber.

3. Apparatus as recited in claim 2 wherein said enlarged cross section of said chamber is generally rounded, for ease of product ejection.

4. Apparatus as recited in claim 3 wherein said pusher means has a leading edge configured for smooth continuity with said enlarged cross section of said chamber when said pusher means is disposed in said second position.

5. Apparatus as recited in claim 1, wherein said enlarged cross section is tapered so that said enlarged cross section is wider near a bottom edge of said chamber than near a top edge thereof.

* * * * *